US007543585B2

(12) United States Patent
Torgerson

(10) Patent No.: US 7,543,585 B2
(45) Date of Patent: Jun. 9, 2009

(54) UNOBTRUSIVE PERSONAL AIR FILTRATION DEVICE

(75) Inventor: Garrett Douglas Torgerson, 5013 Dixon Line Way, Sacramento, CA (US) 95821

(73) Assignee: Garrett Douglas Torgerson, Sacramento, CA (US)

( * ) Notice: Subject to any disclaimer, the term of this patent is extended or adjusted under 35 U.S.C. 154(b) by 0 days.

(21) Appl. No.: 11/546,960

(22) Filed: Oct. 13, 2006

(65) Prior Publication Data

US 2008/0087282 A1 Apr. 17, 2008

(51) Int. Cl.
*A62B 18/08* (2006.01)

(52) U.S. Cl. ..... 128/206.29

(58) Field of Classification Search ..... 128/206.29
See application file for complete search history.

(56) References Cited

U.S. PATENT DOCUMENTS 3,651,659 A * 3/1972 Nakao et al. ..... 62/239
3,773,043 A 11/1973 Wachter
3,943,726 A * 3/1976 Miller ..... 62/235.1
4,191,242 A * 3/1980 Kumagai ..... 165/11.1
4,207,882 A 6/1980 Lemere
4,614,186 A 9/1986 John
4,634,117 A 1/1987 Kramer
4,781,184 A 11/1988 Fife
4,915,105 A 4/1990 Lee
4,938,211 A 7/1990 Takahashi
5,086,768 A 2/1992 Niemeyer
5,386,825 A 2/1995 Bates
5,771,885 A 6/1998 Putrello
6,550,479 B1 4/2003 Duxbury
6,971,386 B2 12/2005 Duxbury
7,025,060 B1 4/2006 Nicholson
2004/0237962 A1 12/2004 Russell
2005/0161046 A1 7/2005 Michaels

* cited by examiner

*Primary Examiner*—Chester T Barry

(57) ABSTRACT

A personal air-filtration device directing filtered air at the face without the use of a mask or a mouthpiece is described. The inventive device provides filtered air to the user without obstructing the user's mouth, thus allowing the user to talk and consume food and/or water while in operation.

28 Claims, 4 Drawing Sheets

UNOBTRUSIVE PERSONAL AIR FILTRATION DEVICE

BRIEF SUMMARY OF THE INVENTION

The device described herein filters air for personal use when obstruction of the nose and mouth is undesirable. By blowing filtered air at the nose and mouth region rather than requiring the user to wear a facemask or a mouthpiece, the inventive device allows users to breathe and speak freely and consume food and water while the device is in place. Because breathing is completely unobstructed, the device is ideally suited to outdoor activities associated with high respiratory rates such as fast walking, running, or cycling.

BACKGROUND OF THE INVENTION

Exposure to particulate matter and other contaminates such as ozone can damage delicate lung tissue. For this reason, medical studies recommend that people breathe filtered air when the air quality is poor. This is particularly true during physical exercise when the lungs not only process greater amounts of air, but also expand to a greater extent, thus allowing contaminates to penetrate further into lung tissue. To prevent such exposure, medical and air quality professionals recommend cessation of exercise while exposed to poor air quality.

Air quality problems are dramatically worse near roadways where vehicles operate. Vehicles not only create and stir up particulate matter in the air, but also introduce contaminates such as carbon monoxide, various hydrocarbons, and oxides of nitrogen, all of which are both unhealthy and contribute to the formation of ozone. Ozone has been shown to lead to a variety of lung conditions in humans including asthma, reduction in lung function, and even premature death. Since bicyclists, joggers, and walkers often utilize vehicle roadways, they are especially prone to unhealthy exposures to each of these pollutants, even when overall air quality is otherwise within acceptable limits.

It is not necessary that all poor-quality air be filtered in order to ensure that the air quality is safe to breathe. Rather, diluting unfiltered air with sufficient filtered air will bring the air quality within acceptable limits.

Properly filtered air allows people to exercise safely even when ambient air quality is poor, however existing air filtration systems are not suited to all circumstances. Many existing systems are not portable. Systems that are portable usually require obstruction of the nose or mouth passage with a mask or a mouthpiece. These limitations can prevent not only unobstructed breathing, but also talking and the consumption of food and water while the systems are in place. For people engaged in activities such as walking, jogging, or bicycling, these limitations make use of the existing air filtration devices undesirable.

One consequence of the existing filtration limitations is that people who would otherwise commute on bicycles will drive vehicles on poor air quality days when automobile use is discouraged, thus exacerbating the already poor quality of the air.

SUMMARY OF THE INVENTION

The present invention is a portable device that filters air for personal use, conveying the filtered air in a stream directed toward the mouth and/or nose. Unfiltered air is drawn into the filter housing and through the filter by a means, such as a fan. The filtered air is then forced through a tube or some form of ducting extending from the filter housing to a nozzle, which then directs the filtered air at the nose and mouth without requiring direct contact with the nose or mouth.

The filter and fan assembly can be located wherever is convenient based upon the activity. For instance, during cycling the unit may be positioned behind the neck, on the helmet, or integrated into the helmet. For walking or jogging, it may be strapped to the user's arm, hang from neck in front of the user, or be positioned around the waist. By positioning the filter in a place where the source air is more likely to be clean, the user can also extend filter life.

The filter seals tightly within the filter housing to ensure that air does not bypass the filter. When not in use, the housing may be sealed closed from ambient air, thus extending filter life. Depending upon the application, different filters may be used to filter different air contaminants.

The hose directing the airflow can be supported in several ways based upon user needs. For example, in some cases, the hose can be supported by a stand resting on the neck and shoulders region. For activities in which a helmet is worn, the hose can be supported by the helmet or even integrated into the helmet. The hose may be flexible and extendable and can be positioned by the user depending upon the user's preferences. Also, different activities may require different hose and nozzle positions to account for relative wind speed and direction. For example, during cycling where the user is tucked forward, the nozzle will be positioned higher on the face than would be the case with jogging. Similarly, the user may position the nozzle closer to or further from the mouth and/or nose based upon needs and preferences.

Airflow rates can be adjusted depending upon the activity in which the user is engaging. Because the filtered air is not conveyed directly into the mouth, there will usually be some dilution of the filtered air with ambient air. By adjusting the airflow, the user can balance the need for filtered air against the need for extending battery and filter life based upon the conditions for which the inventive device is used. For example, users with low-respiratory rates on calm days will require considerably less filtered airflow than would a heavily respiring user on a windy day. Furthermore, when filtering is not necessary, as might be the case when leaving a roadway, the fan could be switched off to extend battery life.

The present invention addresses problems with existing filters and respirators currently being used. The user will be able to breathe filtered air without any obstruction to air flow, to the nose, and to the mouth while moving around freely outdoors. Consequently, users will be able to speak, eat and drink while wearing the device, thus making it ideally suited for exercise.

DETAILED DESCRIPTION OF THE INVENTION

The inventive device shown in FIGS. 1 through 4 is used to filter ambient air for portable personal use. Unlike existing personal air filtration devices, it does not require contact with either the nose or mouth region of the human face, nor does it require that a mask be worn. Instead, filtered air is blown at the nose and mouth region. While this will allow some dilution with unfiltered ambient air, inhaled air quality will be dramatically improved.

The device works by drawing in ambient air through a vent cap 3, through an activated carbon air filter 6 and past the filter stay 5 using a blower motor 4 which is held in place by the blower motor case 2. The vent cap 3 snaps into the blower motor case 2 to hold filter 6, the filter stay 5, and the blower motor 4 in place. Filtered air is then blown from the blower 4 through the opening in the blower motor case 2 and into the air tube 7 which is snapped into the blower motor case 2 at the blower motor case 2 opening. The air is then blown through the air tube 7 and out the tube nozzle 9 which is directed at the nose and/or mouth of the user.

The filter assembly 1 (also shown as FIG. 1) is positioned on the top of a bicycle helmet 10 worn by a human head 11 as shown in FIGS. 2, 3, and 4 and held in place using a joining medium such as Velcro. A strut 8 attaches the air tube 7 to the bicycle helmet 10 and holds the air tube in place while the device is in use.

The unit can be turned on and off using the switch located on the rechargeable battery pack that can be either strapped to the arm of the user or worn around the user's waist.

Figure 1:
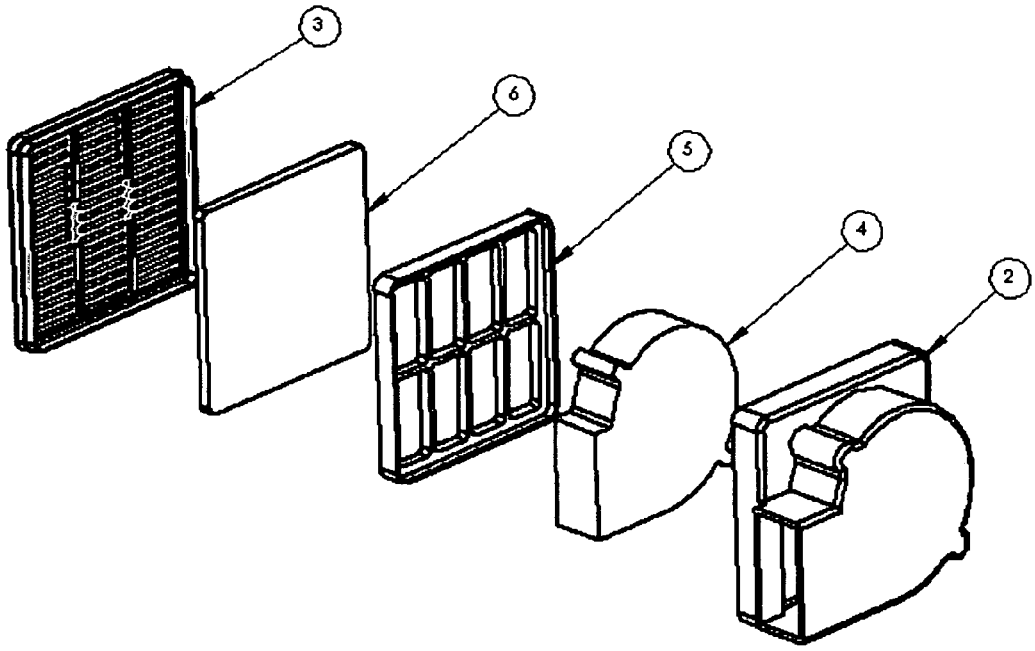
FIG. 1 is an exploded view of the air filter assembly portion of the inventive device
Figure 2:
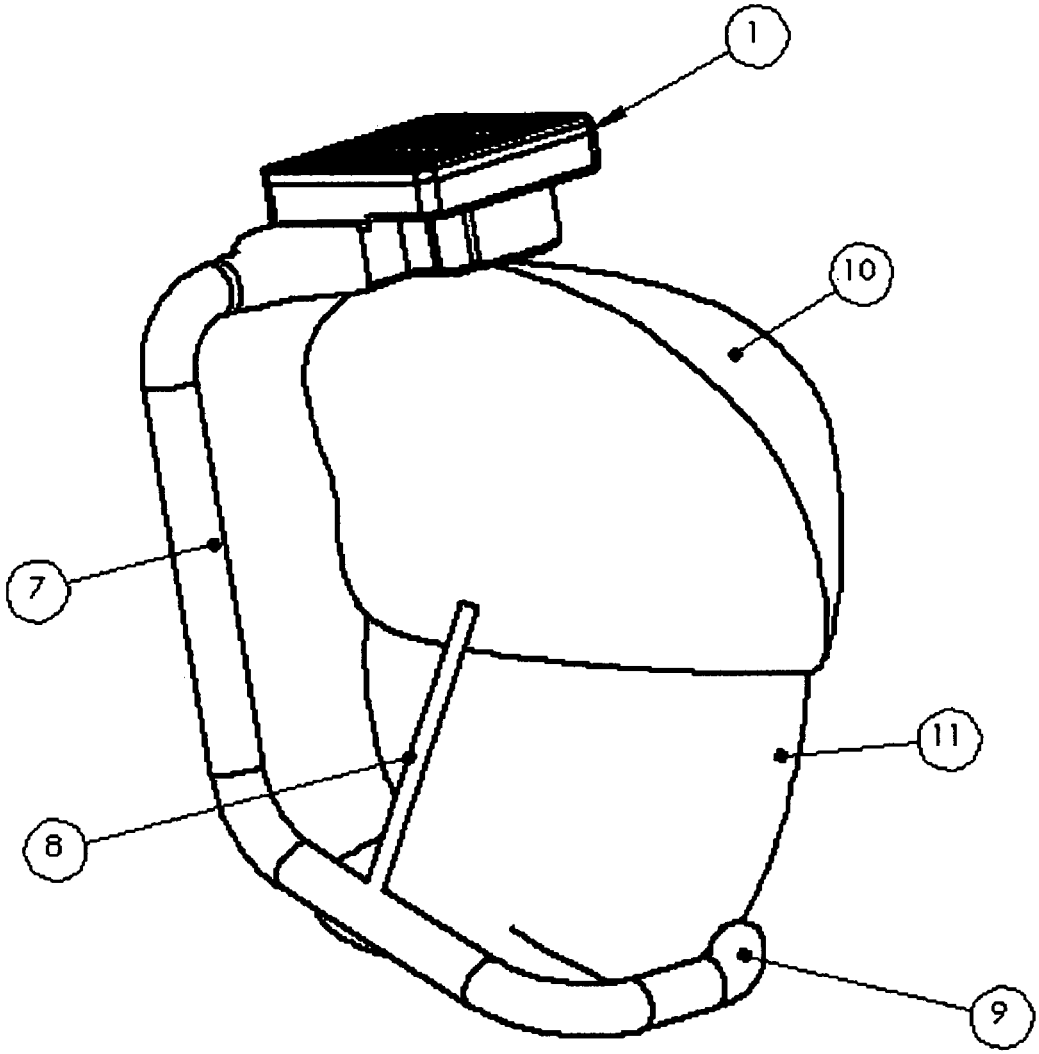
FIG. 2 is an isometric view of the air filtration device positioned on a bicycle helmet worn by a human head
Figure 3:
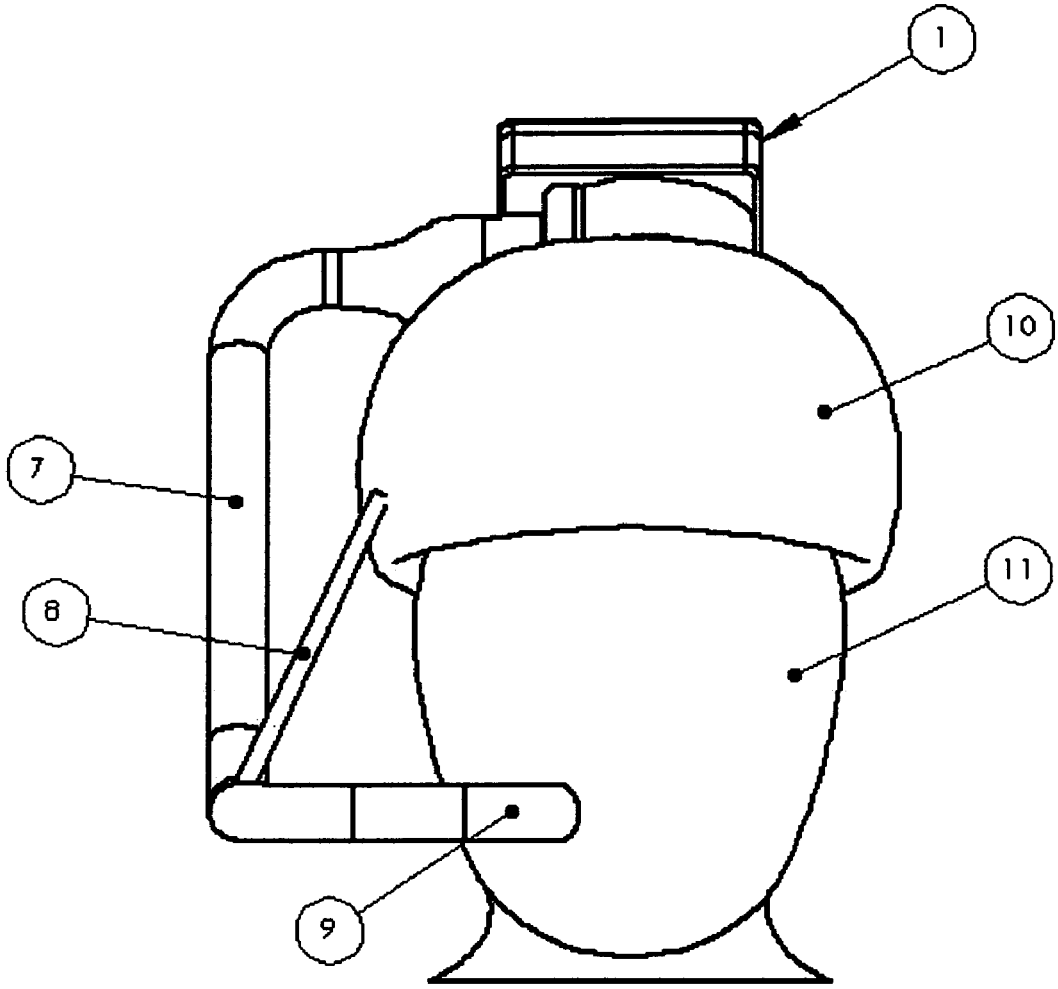
FIG. 3 is a front view of the air filtration device positioned on a bicycle helmet worn by a human head
Figure 4:
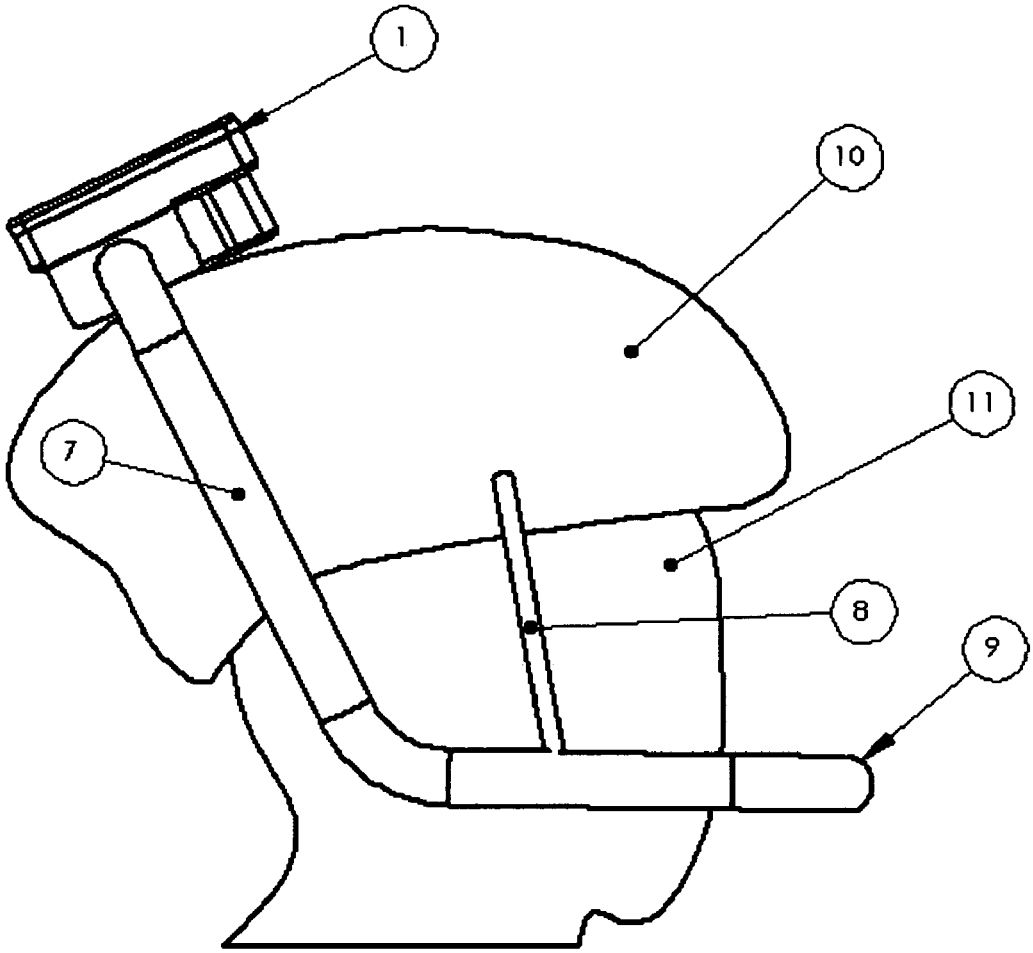
FIG. 4 is a side view of the air filtration device positioned on a bicycle helmet worn by a human head

What is claimed is:

1. A portable personal respiratory device that doesn't use a face mask or face shield and is worn on the user's person comprising: (a) a means of conveying air flow to the mouth and nose region of the human face; (b) at least one air filter through which air conveyed to the mouth and nose by said means is passed; (c) a means of forcing ambient air through said filter and said means of conveying air flow.

2. The device of claim 1, wherein said means of conveying air flow to the mouth and nose comprises one or more air flow tubes.

3. The device of claim 2 wherein said air-flow tubes can be bent to conform to different positions.

4. The device of claim 2 or 3 wherein said air-flow tubes can be extended to different lengths.

5. The device of claim 1 wherein said means of conveying air flow incorporates a nozzle to direct the flow of air to the mouth and nose of the human face.

6. The device of claim 1 wherein the means of forcing air through said filter and said means of conveying air flow is a propeller-style fan.

7. The device of claim 1 wherein the means of forcing air through said filter and said means of conveying air flow is a centrifugal blower fan.

8. The device of claim 1 wherein the means of forcing air through said filter and said means of conveying air flow is a billows-style air pump.

9. The device of claim 1 wherein the means of forcing air through said filter and said means of conveying air flow is relative air velocity caused by movement on a bicycle.

10. The device of claims 1, 6, 7, or 8 wherein an electric motor is used to drive the fan.

11. The device of claim 10 wherein a battery provides electricity to said electric motor.

12. The device of claim 10 wherein solar power provides electricity to said electric motor.

13. The device of claims 1, 6, 7, or 8 wherein the pump or fan is manually driven.

14. The device of claim 1 wherein the air filter is mounted on a helmet worn by the user.

15. The device of claim 1 wherein the air filter is worn on the back of the user.

16. The device of claim 1 wherein the air filter is hung from the neck of the user.

17. The device of claim 1 wherein the air filter is attached to the arm of the user.

18. The device of claim 1 wherein the air filter is integrated into a hehnet worn on the head of the user.

19. The device of claims 1, 6, 7, or 8 wherein the air filter is positioned upstream of the fan.

20. The device of claims 1, 6, 7, or 8 wherein the air filter is positioned downstream of the fan.

21. The device of claims 1, 6, 7, or 8 wherein the air filter and fan are located in one housing.

22. The device of claims 1, 6, 7, or 8 wherein the air filter and fan are located two separate housings.

23. The device of claim 10 wherein the flow of electricity can be controlled by the user.

24. The device of claim 1 wherein the filter can be replaced.

25. The device of claim 1 wherein the filter housing can be sealed closed from ambient air.

26. A portable personal air filtration device that doesn't use a face mask or face shield and is worn on the user's person wherein the air inhaled by the user is diluted with 20% or more by volume of air that has not passed through the filter of said device.

27. The device of claim 26 wherein the dilution exceeds 20% by volume on a continuous basis.

28. The device of claim 26 wherein the dilution exceeds 20% by volume on a sporadic basis.

* * * * *